United States Patent [19]

Pradel et al.

[11] Patent Number: 4,730,387

[45] Date of Patent: Mar. 15, 1988

[54] APPARATUS FOR FITTING RETAINING RINGS

[75] Inventors: Nicolas Pradel, Lyon; Alain Bruyere, Ville Fontaine, both of France

[73] Assignees: Commissariat a l'Energie Atomique, Paris, France; Etablissement Brochier S.A., Decines Cedex, both of France

[21] Appl. No.: 73,402

[22] Filed: Jul. 14, 1987

Related U.S. Application Data

[63] Continuation of Ser. No. 805,955, Dec. 5, 1985, abandoned.

[30] Foreign Application Priority Data

Dec. 11, 1984 [FR] France ..... 84 18898

[51] Int. Cl.[4] ..... B23D 19/00

[52] U.S. Cl. ..... 29/790; 300/4

[58] Field of Search ..... 29/429, 430, 432.1, 29/790, 432, 336, 458, 417; 300/3, 21

[56] References Cited

U.S. PATENT DOCUMENTS 3,977,069 8/1976 Domainque, Jr. ..... 29/417 X
4,437,221 3/1984 Bompard et al. ..... 300/3 X

FOREIGN PATENT DOCUMENTS 2408676 8/1979 France .
2509706 1/1983 France .

*Primary Examiner*—Timothy V. Eley
*Attorney, Agent, or Firm*—Pearne, Gordon, McCoy & Granger

[57] ABSTRACT

An apparatus making it possible to fit retaining pins on a mandrel. The retaining pin arrives in the form of a continuous wire which is cut to the desired length by a wheel before being fitted in the mandrel. The end of the uncut retaining pin adjacent to the wheel is maintained in a gripper formed by two jaws. Simultaneously with the fitting of the cut retaining pin, a hole is made in the mandrel to permit the subsequent fitting of a retaining pin.

8 Claims, 4 Drawing Figures

APPARATUS FOR FITTING RETAINING RINGS

This is a continuation of application Ser. No. 805,955, filed on Dec. 5, 1985 and now abandoned.

BACKGROUND OF THE INVENTION

The present invention is an apparatus for fitting retaining or locking pins on a support mandrel made from a material able to receive such pins by direct pressure fitting.

For the production of hollow members of revolution formed from wires extending in at least three different directions not in the same plane, French Pat. No. 2,408,676 already proposes fitting retaining pins radially on a support mandrel and then arranging superimposed wire layers in the longitudinal and circumferential passages formed between the retaining pins by using winding and weaving. The thus obtained member is impregnated with a thermosetting resin, whereof the polymerization makes it possible to harden the entity.

In practice, at least the peripheral part of the mandrel is made from a rigid foam, such as a phenolic or polyurethane foam. The retaining pins are generally made from prepolymerized fibrous elements.

In view of the homogeneity defects of the foam of the mandrel and the straightness defects of the retaining pins, the production of thick members with the apparatus described in French Pat. No. 2,408,676 is subject to numerous difficulties. To solve these difficulties, French Pat. No. 2,509,706 proposes making holes beforehand in the mandrel before fitting the pins.

Despite the good results obtained with the apparatus described in the latter patent, both it and the apparatus according to French Pat. No. 2,408,676 have certain limitations, mainly due to the need of supplying them with previously cut retaining pins.

In both cases the retaining pins are supplied to the fitting apparatus by gravity. Thus, the apparatuses can only be positioned vertically above the mandrel, which suffers from obvious disadvantages, particularly during the production of large members, because the supply apparatus is then difficult to access and prevents any removal of the member from the top using lifting gear.

Moreover, the supply of cut retaining pins to existing fitting apparatuses generally takes place with the aid of vibrating bowls, whose structure makes it impossible to fit very long retaining pins.

Finally, in the apparatus described in French Pat. No. 2,509,706, a drum system is used for intermediate storage and alignment of retaining pins prior to their fitting. This complicates the structure of the machine and consequently increases its cost and the breakdown risks.

SUMMARY OF THE INVENTION

The present invention is an apparatus for fitting retaining pins not suffering from the disadvantages of the prior art and which more particularly make it possible to fit very long retaining rings in any direction and without intermediate storage.

The present invention is an apparatus for fitting retaining pins to a support mandrel made from a material able to receive the retaining pins by direct fitting, comprising a frame supporting a fitting head having at least one passage able to receive a retaining pin, at least one fitting rod extending in a given direction and which can be aligned with said passage, and means for moving said rod in said direction, wherein the frame also supports means for cutting the retaining pin when in said passage and means for displacing said head between a supply and cutting position in which the retaining pin can be supplied in uncut form and be cut by said cutting means and a fitting position in which said passage is aligned with the fitting rod.

In order to define the waiting position of the retaining pin, the frame preferably supports an abutment located in the extension of said passage when the head is in the supply and cutting position.

According to a preferred embodiment of the invention, the frame also supports gripping means able to maintain the uncut retaining pin end adjacent to the said cutting means.

In order to permit a regulation of the length of the fitted retaining pins, means can be provided for moving the cutting means parallel to said passage with respect to the frame.

So as to make it possible to previously make holes in the mandrel, the head preferably supports at least one punch parallel to the passage and means for moving the punch towards a retracted position, said means for displacing the fitting rod simultaneously acting on the punch in the direction corresponding to the fitting of the retaining pin, in order to make a hole in the mandrel, when said head is in the fitting position.

According to another aspect of the invention, the fitting apparatus also comprises means for the stepwise introduction of the continuous pin material into said passage.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
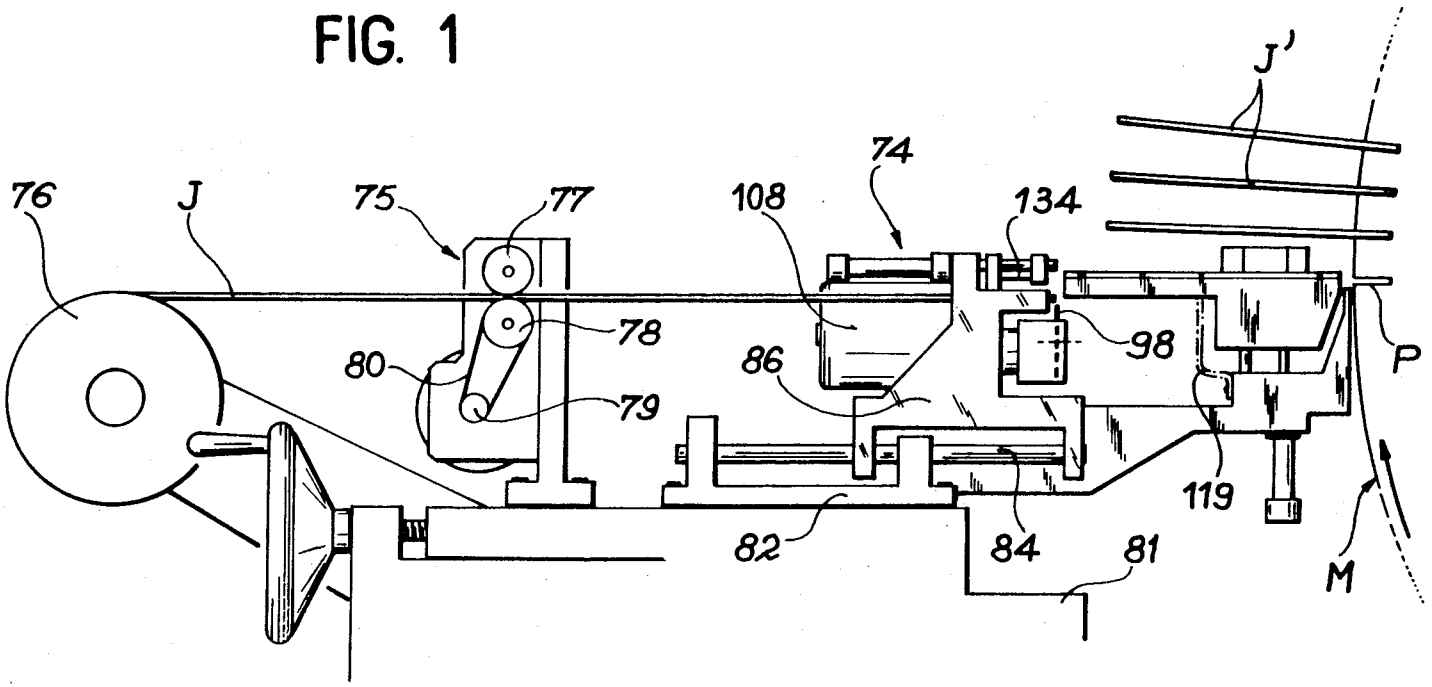
FIG. 1. A side view diagrammatically showing the complete fitting apparatus according to the invention.

As illustrated in FIG. 1, the apparatus according to the invention essentially comprises a means making it possible to cut a retaining pin J constituted by a continuous wire, radially fit the cut retaining pin J' into the mandrel M and make in the latter prior perforations or holes P. The fitting apparatus also comprises a means for the stepwise supply of the continuous retaining pin J to means 74 from a reel 76 on which said pin is wound.

Means 75 comprises two pulleys 77, 78, between which passes the retaining pin J. The latter is moved by rotating pulley 78 controlled by a stepping motor 79 via a belt 80.

In the embodiment shown, the supply and fitting take place horizontally. However, it is also possible to consider other orientations of the apparatus, without any modification thereto. Preferably, but not necessarily, means 74, 75, as well as reel 76 are supported by a single table 81.

Figure 2:
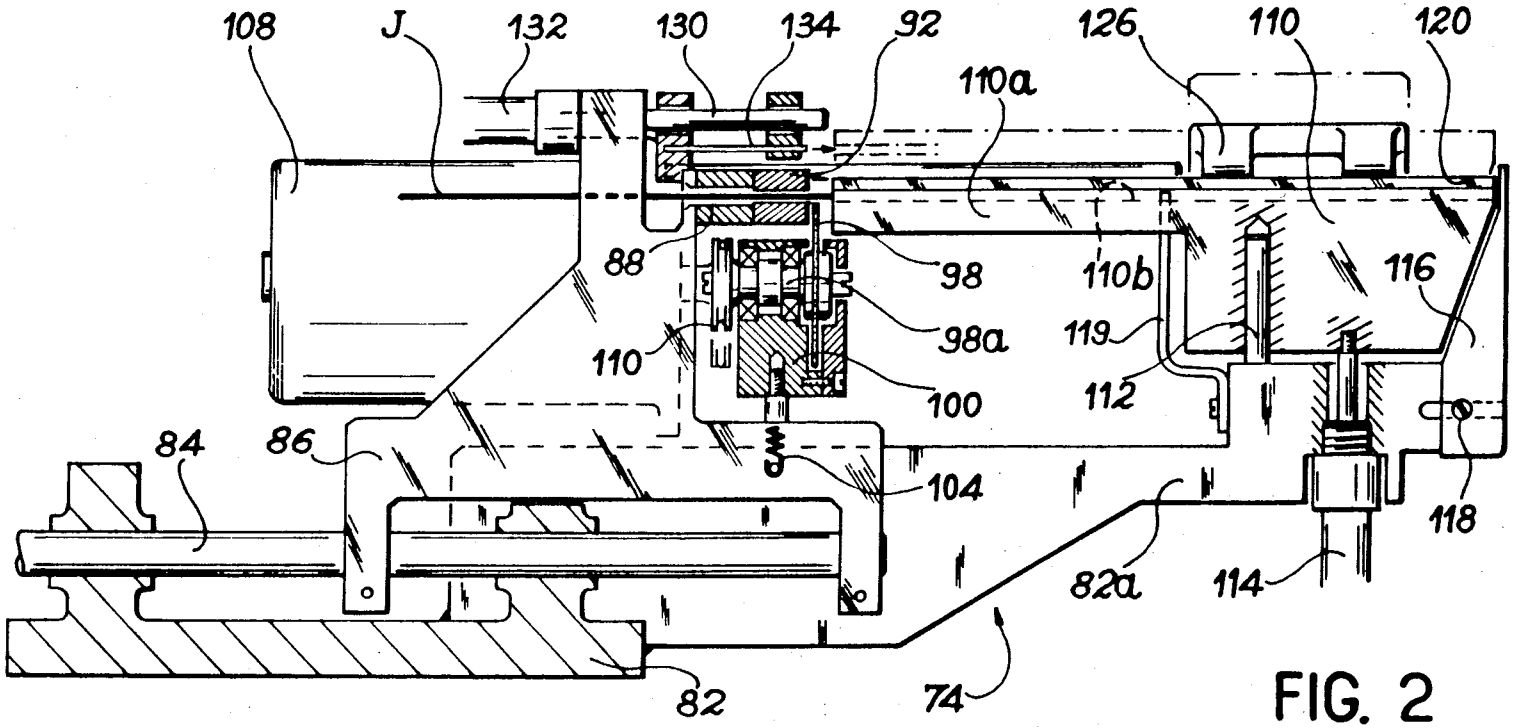
FIG. 2. A side view in partial section and on a larger scale of the complete means for cutting and fitting the retaining pins and for perforating the mandrel of the apparatus according to FIG. 1.
Figure 3:
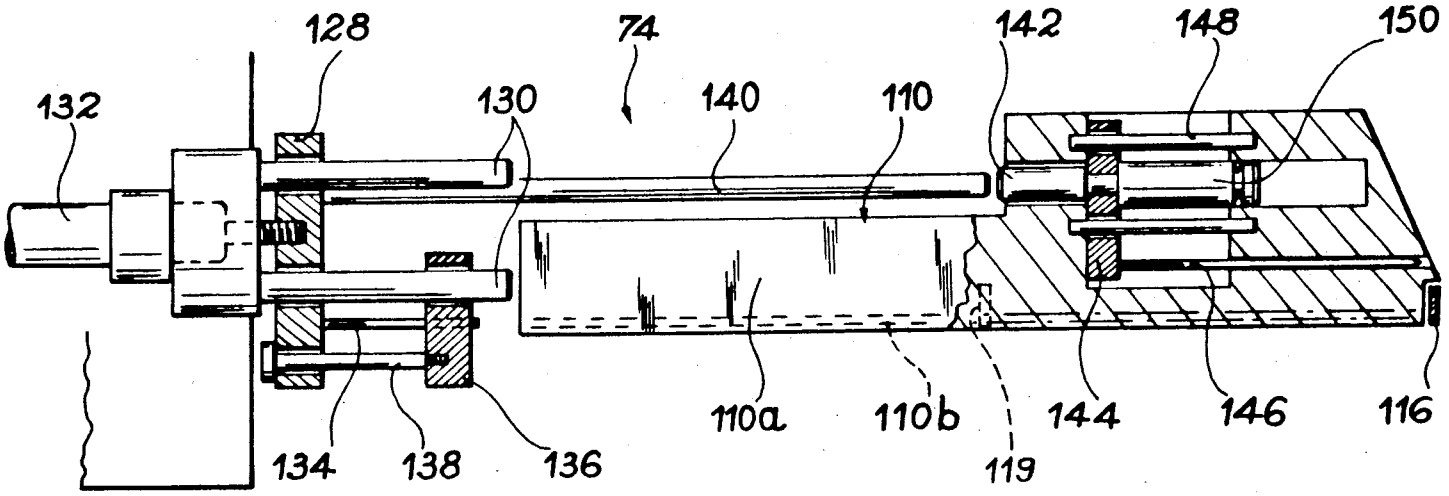
FIG. 3. A plan view in part section of the means shown in FIG. 2.
Figure 4:
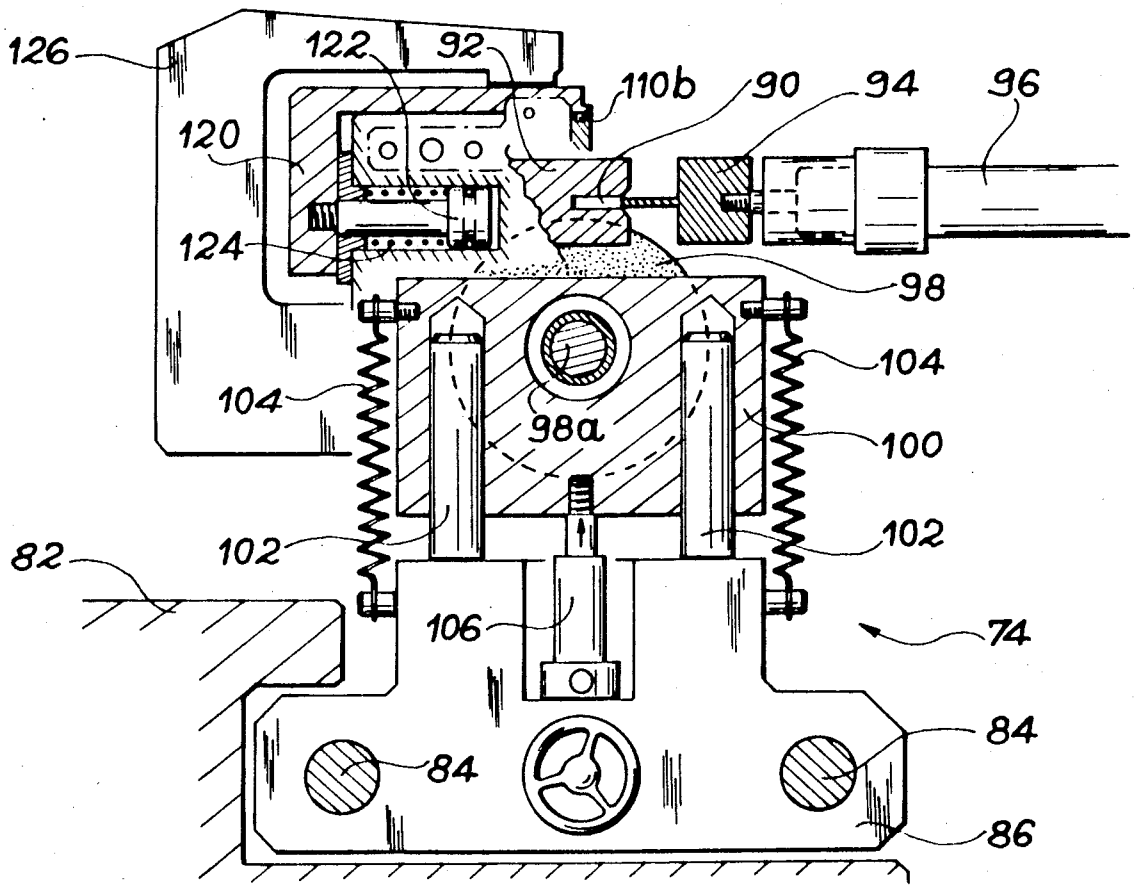
FIG. 4. A sectional view along line IV—IV of FIG. 2.

A detailed description of the means 74 for cutting the continuous retaining pin J, fitting the cut retaining pins J' in mandrel M and for the prior perforation thereof will now be provided with reference to FIGS. 2 to 4.

The means for fitting the retaining pins 74 first of all has a frame 82 fixed to table 81 (See FIG. 1). Frame 82 slidingly supports a support plate 86 in a direction Y parallel to the arrival direction of retaining pin J, i.e. radially with respect to mandrel M, via two columns 84. Regulating the position of support plate 86 on columns 84 makes it possible to vary the length of the fitted retaining pins.

Support plate 86 has a horizontal hole 88 into which is introduced the uncut retaining pin J. The introduction of retaining pin J into hole 88 is carried out stepwise from reel 86 with the aid of the supply means 75 (FIG. 1).

As is more particularly illustrated in FIG. 4, hole 88 is extended by a slot 90 formed in a female jaw 92 integral with support plate 86. A mobile male jaw 94 is mounted in support plate 86, so that it can move perpendicularly to the retaining pin J, i.e. in the case of FIG. 4 parallel to the axis of the mandrel, under the action of a jack 96. Thus, jaws 92 and 94 form a gripper making it possible to hold the end of the uncut retaining pin J during the cutting of a segment J' thereof.

To this end, jaws 92, 94 of the gripper are slightly retracted with respect to a disc-shaped diamond wheel 98 arranged perpendicularly to the retaining pin J. The horizontal spindle 98*a* of wheel 98 is mounted in rotary manner in a wheel support 100 supported by support plate 86. In order to permit the displacement of wheel 98 in a direction perpendicular to that of retaining pin J, support 100 is slidingly mounted on plate 86 via guidance columns 102. Draw or tension springs 104 are attached to support 100 and to plate 86 in order to bring wheel 98 into a position such that it is not located in the extension of hole 88 and slot 90. This waiting position is shown in FIGS. 2 and 4.

The movement of the wheel counter to the action of springs 104 in order to control the cutting of the retaining pin J is carried out by means of a jack 106 placed between plate 86 and support 100. The rotation of wheel 98 is controlled by a motor 108 mounted on plate 86 and rotating the wheel spindle 98*a* via a belt and pulley system 110 positioned substantially perpendicularly to the displacement direction of support 100, so that the belt permanently bears against the pulleys.

FIG. 2 shows that the frame 82 has an extension 82*a* extending in the direction of the mandrel. At its end, extension 82*a* supports a fitting head 110 for placing in the immediate vicinity of mandrel M. Head 110 has an extension 110*a*, which extends radially towards the outside with respect to the mandrel to the vicinity of wheel 98, in order to ensure the guidance of the retaining pin J within a groove 110*b* forming a passage which can be located in the extension of hole 88.

Fitting head 110 is mounted on the end of extension 82*a*, so that it can move alternately upwards or downwards perpendicular to the horizontal path of retaining pin J. To this end, head 110 is mounted slidingly on columns 112 integral with the frame extension 82*a*. The control of the displacement of head 110 along columns 112 takes place by means of a jack 114 placed between extension 82*a* and head 110. This vertical displacement of head 110 alternately brings the latter into a supply and cutting position in which groove 110*b* is placed in the extension of hole 88 by which retaining pin J arrives (in continuous line form in FIG. 2) and a fitting position located above the loading position (in mixed line form in FIG. 2).

When head 110 is located in the loading position shown in continuous line form in FIG. 2, an abutment 116 joined to the end of extension 82*a* closes to the mandrel by a screw 118 permitting a regulation of the position of the abutment is located in the extension of groove 110*b*. Retaining pin J is consequently stopped by abutment 116 when introduced into groove 110*b*.

When it is wished to fit retaining pins of limited length, on frame extension 82*a* between abutment 116 and wheel 98 is fitted a detachable tongue 119, whose end covers groove 110*b* when head 110 is located in the loading position shown in continuous line form in FIG. 2. The retaining pin J is then stopped by tongue 119 when introduced into the groove. The rectilinear or s-shaped configuration of the tongue defines the length of the retaining pin cut by wheel 98.

Over the entire length of head 110, including extension 110*a*, the open side of groove 110*b* is normally closed by a door 120 (FIGS. 2 and 4), so as to constitute a passage for the retaining pin. Door 120 is mounted on head 110, so that it can slide in the horizontal plane perpendicular to the direction of retaining pin J under the action of a piston 122. A spring 124 normally maintains the door in its position ensuring the closing of groove 110*b*, the putting into action of piston 122 having the effect of permitting the rotation of the mandrel following the fitting of a retaining pin J'.

As is more particularly illustrated in FIG. 4, a stirrup 126 integral either with frame 82 or with head 110 positions door 120 against head 110 level with groove 110*b*.

As is more particularly illustrated in FIGS. 2 and 3, plate 86 also slidingly supports plate 128 approximately above jaws 92 and 94 of the gripping system and the retaining pin cutting means associated therewith. Plate 128 moves parallel to the radial direction defined by retaining pin J on columns 130 fixed to plate 86, under the action of a jack 132 which is also mounted on the latter.

Support plate 128 firstly supports a thrust rod 134 located in the extension of groove 110*b* formed in head 110, when the latter is in the upper fitting position. In view of the fact that in this position, abutment 116 no longer faces the end of groove 110*b* closest to the mandrel, it is apparent that the putting into action of jack 132 introduces the thrust rod 134 into groove 110*b*, which has the effect of fitting in mandrel M the cut retaining pin J' located in the groove over a length slightly less than this displacement.

Preferably and as illustrated in FIG. 3, the end of thrust rod 134 passes through a guide 136, which slides on one of the columns 130 and itself supports a parallel column 138 slidingly received in support plate 128.

As is more particularly illustrated in FIG. 3, plate 128 also supports a pre-hole control rod 140, which is also positioned parallel to radial direction defined by retaining pin J. When head 110 is located in its upper fitting position, the end of rod 140 bears on an anvil 142 slidingly mounted in head 110. Anvil 142 is integral with a punch-holder plate 144 supporting a punch 146. Punch 146, which is also located in the radial direction defined by retaining pin J, traverses the end of rod 110, so that its end is normally flush with the terminal face of the fitting head when it is in the retracted position. The assembly constituted by anvil 142, plate 144 and punch 146 moves within head 110 parallel to the direction defined by retaining pin J on posts 148.

Through the action of rod 40 on anvil 142, putting jack 132 into operation makes it possible to embed punch 146 in the mandrel, at the same time as a previously cut retaining pin J' is embedded by rod 134 in a hole P previously made by rod 134 in a hole P previously made in the mandrel by punch 146. Thus, simultaneously the mandrel is perforated and a cut retaining pin is fitted in a previously punched hole or perforation.

In view of the fact that the fitting head 110 can move between a fitting position and the supply and cutting position, it is not possible to control the return of punch 146 by acting on jack 132. Therefore, it can be seen in FIG. 3 that a return piston 150 is interposed between head 110 and plate 144 opposite to anvil 142.

The fitting apparatus described hereinbefore functions sequentially, synchronously with the motors controlling the relative stepwise displacement between mandrel M and said apparatus.

With regards to the relative displacement, it can be brought about by the combination of a stepwise rotation of the mandrel and a stepwise displacement of the fitting apparatus parallel to the adjacent generatrix of the mandrel. These displacements can be obtained by known means.

The fitting apparatus functions as follows. With the fitting head 110 in the supply and cutting position, the gripper formed by jaws 92, 94 open, jack 106, 122 and 132 in the retracted position and piston 150 actuated, using means 75, the uncut retaining pin J is introduced into groove **110*b* until its end abuts against abutment 116. The gripper of the end of the uncut retaining pin J adjacent to wheel 98 is then locked under the action of jack 96**.

This is followed by the cutting of a retaining pin segment J' located in groove **110*b*. To this end, wheel 98 is rotated by motor 108 and jack 106 is put into operation. At the end of cutting, motor 108 is stopped and jack 106 is released, springs 104 then returning the wheel to the waiting position, as shown in FIGS. 2 and 4. Head 110 is then brought into the fitting position by jack 114. Thus, the end of groove 110*b* is no longer covered by abutment 116**.

The putting into action of jack 132 has the effect of simultaneously making a hole P in the mandrel and inserting the retaining pin J', which has just been cut, in a previously made perforation or hole. Jacks 132 and 150 then return the thrust rod 134 and punch 146 to the retracted position.

After putting piston 122 into operation for releasing the retaining pin J' which has just been fitted, head 110 returns to its supply and cutting position under the action of jack 114 and door 120 is immediately closed again.

This is followed by the release of the end of retaining pin J by opening the gripper formed by jaws 92 and 94, so that the initial position is restored. The relative displacements between the fitting apparatus and the mandrel can then be controlled in order to bring about an advance by one step before recommencing the same succession of operations.

What is claimed is:

1. An apparatus for fitting retaining pins to a support mandrel made from a material able to receive the retaining pins by direct fitting, comprising a frame supporting a fitting head having at least one passage able to receive a retaining pin, at least one fitting rod extending in a given direction and which can be aligned with said passage, and means for moving said rod in said direction, wherein the frame also supports means for cutting the retaining pin when in said passage and means for displacing said head between a supply and cutting position in which the retaining pin can be supplied in uncut form and can be cut by said cutting means, and a fitting position in which said passage is aligned with the fitting rod.

2. An apparatus according to claim 1, wherein the frame supports an abutment located in the extension of the passage when the head is located in the supply and cutting position.

3. An apparatus according to claim 1, wherein the frame also supports gripping means able to maintain the uncut retaining pin end adjacent to said cutting means.

4. An apparatus according to claim 1, wherein the means for regulating the length of the fitted retaining pins displace the cutting means parallel to the passage with respect to the frame.

5. An apparatus according to claim 1, wherein the head supports at least one punch parallel to said passage and means for bringing the punch into a retracted position, the means for displacing the fitting rod acting simultaneously on the punch in the direction corresponding to the fitting of the retaining pin, so as to make a perforation in the mandrel when the head is in the fitting position.

6. An apparatus according to claim 1, wherein one of the sides of the passage is formed by a normally closed detachable door actuated by opening means when a relative displacement has to take place between the fitting apparatus and the mandrel.

7. An apparatus according to claim 1, wherein it also comprises means for the stepwise introduction of the continuous retaining pin into said passage.

8. An apparatus according to claim 1, wherein the frame supports a detachable tongue, whereof the end penetrates the passage when the head is in the supply and cutting position.

* * * * *

UNITED STATES PATENT AND TRADEMARK OFFICE

CERTIFICATE OF CORRECTION

PATENT NO. : 4,730,387

DATED : March 15, 1988

INVENTOR(S) : Pradel et al.

It is certified that error appears in the above-identified patent and that said Letters Patent is hereby corrected as shown below:

Amend the Title of the Patent to read --Apparatus for Fitting Retaining Pins on a Mandrel--.

Column 1, line 59, delete "rings" and insert --pins--.

Signed and Sealed this

Twenty-seventh Day of September, 1988

*Attest:*

DONALD J. QUIGG

*Attesting Officer*

*Commissioner of Patents and Trademarks*